United States Patent [19]

Striegler et al.

[11] 4,007,788

[45] Feb. 15, 1977

[54] RECOVERY OF BITUMEN FROM TAR SANDS

[75] Inventors: John Howard Striegler, Richardson; Eddie Paul Howell, Plano, both of Tex.

[73] Assignee: Atlantic Richfield Company, Los Angeles, Calif.

[22] Filed: June 6, 1975

[21] Appl. No.: 584,515

[52] U.S. Cl. ..... 166/272; 166/52

[51] Int. Cl.[2] ..... E21B 7/04; E21B 43/24

[58] Field of Search ..... 166/256, 259, 271, 272, 166/281, 285, 288, 303, 50, 52; 175/62

[56] References Cited

UNITED STATES PATENTS

| | | | |
|---|---|---|---|
| 2,271,005 | 1/1942 | Grebe | 166/50 X |
| 2,584,605 | 2/1952 | Merriam et al. | 166/272 X |
| 2,778,603 | 1/1957 | McCune et al. | 166/50 X |
| 2,974,937 | 3/1961 | Kiel | 166/272 X |
| 3,285,350 | 11/1966 | Henderson | 175/62 X |
| 3,338,306 | 8/1967 | Cook | 175/62 X |
| 3,386,508 | 6/1968 | Bielstein et al. | 166/272 |
| 3,933,447 | 1/1976 | Pasini et al. | 166/259 X |

*Primary Examiner*—Stephen J. Novosad
*Assistant Examiner*—George A. Suchfield
*Attorney, Agent, or Firm*—Ronnie D. Wilson

[57] ABSTRACT

A method of recovering bitumen from a subterranean tar sand formation characterized by a plurality of steps. First, a continuous wellbore having a second section thereof contained within the formation and first and third sections thereof extending the second section to the earth's surface is formed. Next, the first and third sections of the wellbore are cased. Thereafter, a heated fluid is circulated through the wellbore contacting the formation to reduce the viscosity of the bitumen contained therein rendering the bitumen mobile. Subsequently, bitumen mobilized by the heated fluid is recovered via the wellbore.

1 Claim, 1 Drawing Figure

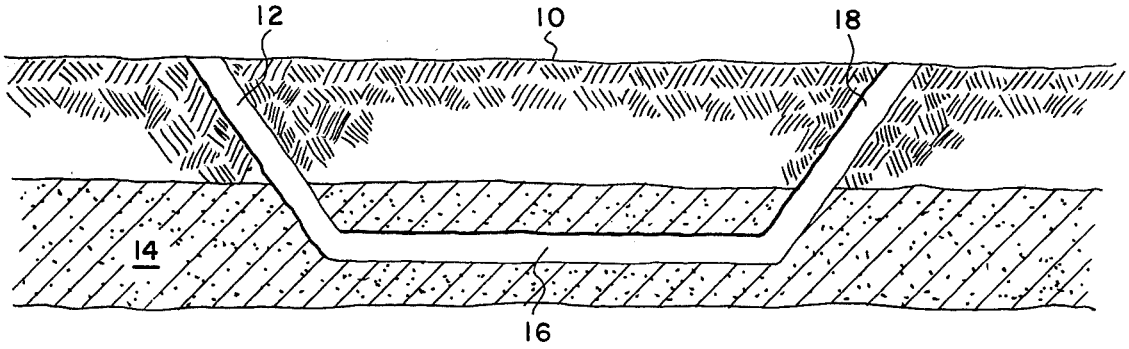
12
10
18
14
16

RECOVERY OF BITUMEN FROM TAR SANDS

The present invention relates to the recovery of bitumen from a subterranean tar sand formation by means of a fluid drive. More particularly it is concerned with the recovery of bitumen by steam injection via a continuous horizontal wellbore within the formation. The steam serves both as a driving agent to force the bitumen to the production well and as a viscosity lowering agent to mobilize the bitumen over a substantial portion of the formation.

Large deposits of petroleum exist in the world which cannot be produced efficiently by conventional methods because of their extremely high viscosity. Such deposits include the Athabasca tar sands in Canada, the Jobo region in Venezuela, and the Edna and Sisquoc regions in California. In the Athabasca region alone upwards of 1500 billion barrels of oil may be present. Only a small portion of these tar sands are recoverable by surface mining techniques. It is all too clear that if these energy values are to be recovered for this generation and those to come they must be recovered by in situ techniques. Various proposals have been set forth for recovering the petroleum of the type contemplated herein. Some have involved steam injection, in-place combustion, etc., but none have been very successful as yet. The well-known huff-and-puff process, for recovering petroleum in which steam is injected into a formation for a period of time after which the steam-saturated formation is allowed to soak for an additional interval prior to placing the well on production, has too much of a time lapse before production is obtained. One of the principle reasons for the lack of success of previously attempted steam injection techniques for recovering bitumen from a tar sand formation has been the difficulty in providing a permeable, competent communication path or zone connecting injection wells and production wells. The present invention provides a method for overcoming these previously encountered problems in recovering bitumen from tar sands.

It is therefore an object of the present invention to provide a process by which heat can be applied to a large volume of a tar sand formation while simultaneously forcing the bitumen of reduced viscosity from the formation to production. It is a particular object of the present invention to provide a method for recovering bitumen from a subterranean tar sand formation via a continuous wellbore in the formation. It is another object of our invention to recover bitumen from a subterranean tar sand formation by circulating a heated fluid through a wellbore in said formation having both end sections thereof cased and extending to the surface.

These and other objects will become apparent from the descriptive matter hereinafter, particularly when taken in conjunction with the FIGURE.

In accordance with the present invention, bitumen is recovered from a subterranean tar sand formation by the following multi-step method. First, a continuous wellbore having a second section thereof contained within the formation and first and third sections thereof extending said second section to the earth's surface is formed. Next, the first and third sections of the wellbore are cased. Thereafter, a heated fluid is circulated through the continuous wellbore contacting the formation to reduce the viscosity of the bitumen contained therein. Subsequently, bitumen mobilized by the heated fluid is recovered via the wellbore.

The figure illustrates a vertical section of a subterranean tar sand formation penetrated by a continuous wellbore having both ends thereof extending to the surface of the earth.

Referring to the figure, the drawing illustrates the earth's surface 10 from which a wellbore's first section 12 has been drilled by well-known means to penetrate a subterranean tar sand formation 14 and having a second section 16 extending therethrough and turning upward at third section 18 to the earth's surface. Wellbore sections 12 and 18 are cased.

In carrying out an embodiment of the present invention and referring to the figure, we have a continuous wellbore having first and third sections 12 and 18 and second section 16 penetrating the subterranean tar sand formation 14. Initially, first section 12 of the wellbore is drilled to penetrate the tar sand formation 14 and the section is cased. Subsequently, a second section 16 and third section 18 are drilled providing a continuous wellbore extending through the formation. The drill pipe utilized for the wellbore is then withdrawn into second section 16 from third section 18 in order that the casing of third section 18 may take place. After casing third section 18, injection of a heated fluid such as steam or hot water is begun via first section 12 of the continuous wellbore. While injecting a heated fluid, the drill pipe is withdrawn from the second section 16 to the surface 10 at such a rate that to prevent plugging i.e. if the hole is sloughed it is filled with clean sand so as not to interrupt the drive provided by the heated fluid. As the heated fluid is circulated through the continuous wellbore, the temperature of the tar sand formation is raised and the bitumen contained therein rendered mobile. The mobilized bitumen is recovered via third section 18 by the driving force of the circulating heated fluid. In the operation of the present invention, care should be taken in correlating the fluid composition, the fluid flow rate and the rate at which the fluid temperature is raised above the reservoir temperature, so that an adequate rate of flow is maintained at pressures that remain below the fracturing pressure of the formation.

The diameter and length of the continuous wellbore is not critical and will be determined by conventional drilling criteria, the characteristics of the specific formation, and the economics of a given situation. In order to most efficiently exploit the effects of gravity in recovering the bitumen, the second section of the wellbore should be formed near the bottom of the tar sand formation.

Having thus described the invention, it will be understood that such description has been given by way of illustration and not by way of limitation, reference for the latter purpose being had to the appended claims.

Therefore, we claim:

1. Method of recovering bitumen from a subterranean tar sand formation containing bitumen which comprises:

forming a continuous wellbore having a second section contained within said formation and first and third sections extending said second section to the earth's surface, casing said first and third sections of said wellbore whereby said second section is open to said formation, circulating a heated fluid via said first section through said wellbore contacting said formation and reducing the viscosity of said bitumen contained therein to render said bitumen mobile while withdrawing means whereby said wellbore is formed at a rate to prevent plugging of said second section, and recovering said mobilized bitumen via said third section of said wellbore.

* * * * *